US008424577B2

(12) United States Patent
Poutanen

(10) Patent No.: US 8,424,577 B2
(45) Date of Patent: Apr. 23, 2013

(54) FINGER JOINT

(76) Inventor: Tuomo Poutanen, Tampere (FI)

( * ) Notice: Subject to any disclaimer, the term of this patent is extended or adjusted under 35 U.S.C. 154(b) by 533 days.

(21) Appl. No.: 11/720,386

(22) PCT Filed: Nov. 28, 2005

(86) PCT No.: PCT/FI2005/000512
§ 371 (c)(1),
(2), (4) Date: May 29, 2007

(87) PCT Pub. No.: WO2006/056652
PCT Pub. Date: Jun. 1, 2006

(65) Prior Publication Data
US 2008/0092988 A1 Apr. 24, 2008

(30) Foreign Application Priority Data
Nov. 29, 2004 (FI) ..... 20041529

(51) Int. Cl.
*B27F 1/00* (2006.01)

(52) U.S. Cl.
USPC ..... 144/347; 144/354; 403/364

(58) Field of Classification Search ..... 144/83, 144/218, 231, 368, 371, 347; 52/403.1, 177, 52/480, 690, 729, 841, 838, 847, 848, 854, 52/846; 403/364; 428/60
See application file for complete search history.

(56) References Cited

U.S. PATENT DOCUMENTS 242,513 A * 6/1881 Crane ..... 403/382
1,124,228 A * 1/1915 Houston ..... 403/381
2,267,330 A * 12/1941 Goss ..... 403/265
2,334,113 A * 11/1943 Malarkey ..... 52/455
2,413,912 A * 1/1947 Dosker ..... 403/384
3,204,300 A * 9/1965 Hofmann ..... 403/265
3,452,502 A 7/1969 Price
3,480,054 A * 11/1969 Marian ..... 144/347
3,692,340 A 9/1972 Roth
4,057,356 A * 11/1977 Nissen ..... 403/219
4,074,498 A * 2/1978 Keller et al. ..... 52/690
4,130,150 A * 12/1978 Cook et al. ..... 144/2.1
4,248,280 A * 2/1981 Taylor ..... 144/346
4,383,780 A * 5/1983 Davison ..... 403/219
4,505,086 A * 3/1985 Hansen ..... 52/589.1
4,624,295 A 11/1986 Howland
4,856,569 A * 8/1989 Robson ..... 144/91
4,907,383 A * 3/1990 Winter, IV ..... 52/86
5,114,265 A * 5/1992 Grisley ..... 403/381
(Continued)

OTHER PUBLICATIONS

Yawaza's Original joint work, diamond shaped joint, 2006, http://www.eurus.dti.ne.jp/~k-yazawa/jointwork.html; http://web.archive.org/web/20060812094126/http://www.eurus.dti.ne.jp/~k-yazawa/jointwork.html.*

*Primary Examiner* — David Walczak
*Assistant Examiner* — Jennifer C Chiang
(74) *Attorney, Agent, or Firm* — Stites & Harbison PLLC; Douglas E. Jackson; Stephen J. Weyer

(57) ABSTRACT

A finger joint in a joint assembled of at least mainly woody parts (1, 2), such as sawn timber, glued wood, plywood, fiberboard, LVL, LSL, comprises at least one finger. The finger shapes needed complementarily have been milled with a cutting tool, such as a milling curser, to the both parts (1, 2). The height of at least one complementary pair of fingers varies along the length of the interlocking finger pair.

5 Claims, 2 Drawing Sheets

Figure 1:
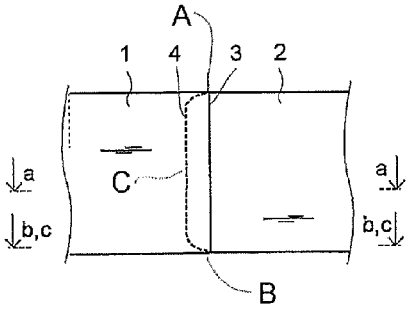

U.S. PATENT DOCUMENTS 5,165,816 A * 11/1992 Parasin ..... 403/334
5,203,639 A * 4/1993 Femrite ..... 403/382
5,653,080 A * 8/1997 Bergeron ..... 52/839
6,023,900 A * 2/2000 Stoehr et al. ..... 52/403.1
6,025,053 A * 2/2000 Grenier ..... 428/172
6,378,579 B1 * 4/2002 Giltner ..... 144/347
6,453,973 B1 * 9/2002 Russo ..... 160/135
6,588,408 B2 * 7/2003 Bedwell et al. ..... 123/668
6,647,689 B2 * 11/2003 Pletzer et al. ..... 52/592.1
6,701,984 B2 * 3/2004 Lamontagne et al. ..... 144/347
6,860,071 B2 * 3/2005 Weaber et al. ..... 52/179
6,880,595 B2 * 4/2005 Nuss ..... 144/135.2
7,131,473 B1 * 11/2006 Brewer ..... 144/371
2002/0015815 A1 * 2/2002 Flach et al. ..... 428/57
2002/0034416 A1 * 3/2002 Lichtenberg et al. ..... 403/270
2002/0076275 A1 * 6/2002 Hernandez et al. ..... 403/364

* cited by examiner

FINGER JOINT

FIELD OF INVENTION

The invention relates to a finger joint between two woody parts with male and female fingers which are cut by a cutting tool to have mostly similar shapes.

BACKGROUND

The use of finger joints in timber joints is common. However, some problems are connected to these joints.

One problem is that the fingers remain visible on all sides, but usually they are visible at least on two sides. The visible fingers cause many kinds of problems. They are an esthetical disturbance. Usually they cannot be painted without rough working as grinding and filling. From visible fingers water and dirt can harmfully penetrate into the wood.

Another disadvantage connected to finger joints is that the finger grooves reach outside the joint. Such a finger joint solution is presented among others in publication U.S. Pat. No. 3,452,502. From connection pieces material is removed outside the joint area, which reduces the firmness. The fingers outside the joint are aesthetically bad and in addition water and dirt can harmfully gather in them. Also such a problem is connected to the finger joints that by assembly the joints are difficult to locate. Finger cuttings do not locate the connection pieces accurately in regard to each other.

Present finger joints are not in an optimal way firm, since they have structural discontinuities, which cause great local tensions.

SUMMARY OF INVENTION

By means of the invention one can get rid of the above described problems. The new joint is better than the former one, especially more extensive as to its field of embodiments, to its visual quality of higher level and firmer, especially a finger joint, the fingers of which are invisible and from the connection pieces no material is removed outside the joint area. The joint according to the invention is characterized in detail hereafter.

In this invention some known technologies are used:

The joint is made by cutting complementary fingers between the pieces, usually advantageously those narrowing towards the tip.

Glue is put in the fingers and they are pressed together. In special cases there are in the joint also nails, screws or other joining means. The purpose of them can be strengthening of joint or to facilitate the manufacture. In another in a special case, when the firmness of joint is secondary or when the joint is made under conditions, where the use of glue is not possible, as outside the factory conditions, there is no glue in the joint nor other joining means, whereby the joint is formed merely through the contact of joint surfaces.

The fingers in the pieces to be connected can be similar, so both the pieces to be connected can be cut with the same cutter only changing the location of the cutter in regard to the connection pieces. However, usually the fingers in connection pieces can be different, whereby two different cutters are needed—mail cutter and female cutter.

In this invention some new solutions are applied:

The heights of fingers vary. The fingers are at their lowest in the joint ends or at least in the other end. The variation of the height of fingers is produced so that the cutter is moved farther from the connection piece to be cut. Usually this means that in addition to the cutting direction the cutter is steered also in the transverse direction. Alternatively the connection piece can in regard to the cutter be moved into place or both of them move. Usually there are in the joint many fingers side by side and often the heights of these parallel fingers vary in the same way in the cutting direction, but it is also possible that the heights of the parallel fingers vary differently. Usually it is advantageous that the fingers on the edges of the joint area are short, e.g. the fingers are short in the beginning and end of cuttings and that the outermost fingers are short.

Usually the height of fingers is in the ends of cuttings fitted to zero. From a solution like this many advantages are achieved: The fingers are invisible and the joint is visually of high quality. In present solutions the finger grooves are partly outside the joint area, whereby these grooves are nests of dirt and water. The new joint is firm, because wood is not cut at all outside the joint area. Great firmness is also achieved, because the height of fingers gets gradually shorter, so in the joint end no great tension peaks appear.

During cutting the cutter is steered along the cutting line about least in the cutting ends often also in the middle.

The cutter has a small diameter. The smaller the cutter the more versatile joints can be made by it. In some cases, for instance when one connection piece is thicker than the other, it is advantageous to carry out cutting of the one with a small cutter and the other with a great one. Then the smaller cutter is usually as small as possible.

Usually the joint surface is rough-worked before finger cutting into a crooked level, which corresponds to tips to be cut. This can be made which the fingers are cut in moving the cursor in the direction of with a separate cylinder cutter or the same finger cursor by means of the axle.

When great firmness is required of the joint, the fingers are strongly narrowing towards the tip. In a joint like this the cutter is in the cutting ends steered perpendicular in regard to the cutting direction, i.e. in the direction of the cutting tool. Alternatively the piece to be cut moves and the cutter stays put or both of them move. Further, the cutting tool can also be circulated. This method is especially useful, if at a time only one finger is cut. The shape of the finger in the joint end is different compared with the fingers in the middle, they are lower, the finger bottoms broader and tips narrower, e.g. with one cutter of the cutting tool many fingers of different shapes can be achieved, i.e. the cutter of the cutting tool cuts a finger groove either as broad as this cutter or one variably broader, and the finger so formed is shorter.

The connection gaps according to the joint of this invention change more than conventional joints, among others because of the inaccuracy of cutting. Therefore it is advantageous to use glue in the joint. It works in quite big connection gaps, even big connection gaps of size 0.6 mm.

List of figures according to the enclosed drawing

FIGS. 1, 2, 3, 4: a joint of two pieces of wood, with respective sections a-a, b-b, c-C.

Figure 5:
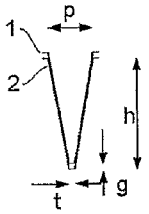
Figure 6:
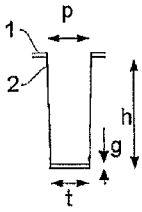
Figure 7:
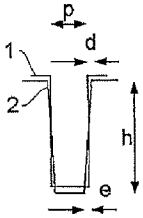

FIGS. 5, 6, 7: different types of fingers.

Figure 8:
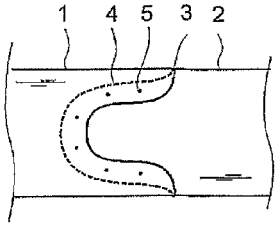

FIG. 8: a joint with crooked cutting groove.

Figure 9:
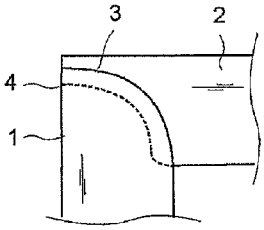
Figure 10:
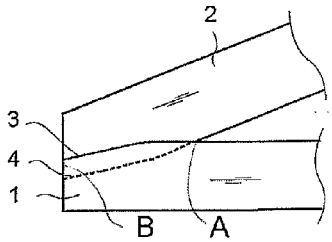

FIGS. 9, 10: different angle joints.

Figure 11:
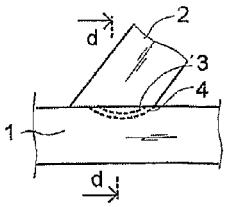
Figure 12:
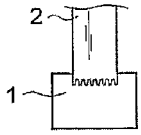

FIGS. 11, 12: different view of T-joint of pieces of thickness.

Figure 13:
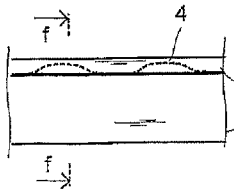
Figure 14:
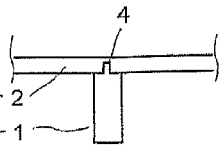

FIGS. 13, 14: different views of a joint of wooden piece and board.

Figure 15:
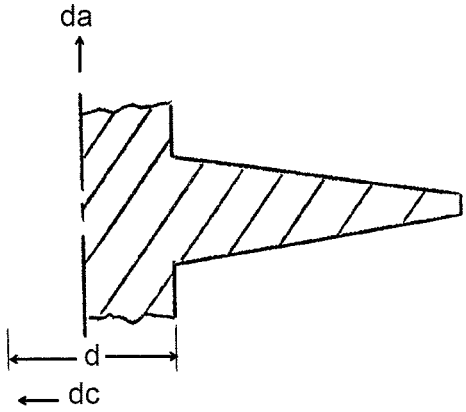

FIG. 15: a schematic view of a portion of a cutting tool.

DETAILED PRESENTATION OF INVENTION

Figure 2:
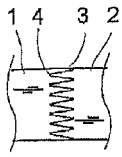
Figure 3:
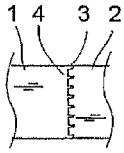
Figure 4:
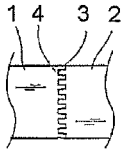

FIG. 1 shows a finger joint of two wooden pieces 1 and 2, and FIGS. 2 and 3 show sections a-a, and b-b and FIG. 4 an alternative section c-c. In this case the joint is made so that seam line 3, visible on the outer surface, is straight, but in some cases it is advantageous that the seam line is crooked. The joint is made advantageously so that part 1 is cut along line 3 usually advantageously with a normal saw. The end of part 2 line is shaped according to line 4 for instance by means of a cylinder cursor or usually advantageously by means of the finger cursor moving it in the direction of the axle. The joint in the middle C is a normal finger joint, FIG. 2, where the finger is narrowing towards the tip. In the case of FIG. 3, the fingers in the ends A, B of cuttings of part 2 get shorter and also broader, which is achieved moving the cutter in the direction of the axle. By working part 2, the cutting tool is not moved in the direction of the axle. A solution like this is in many respects usable, since working of fingers is simple. The firmness is great, taken into consideration that the broader fingers are fitted on the critical side. In some cases the cutter cannot be moved at all in the direction of the axle. Alternatively the fingers of parts 1 and 2, FIG. 4, are cut get broader in the same way. A solution like this is very good by joint assembling, the fingers do not break easily and the parts are easily and accurately located in regard to each other. If one wants to get high quality cutting edges the direction of rotation of the cutting tool cutting is in the cutting ends fitted in the direction of the cutting tool, i.e., so called counter feeding, the cutting tool rotation of the cutting tool is different in the different ends A, B of the cutting groove.

FIG. 5 shows a conventional narrowing of complementary pair of fingers between connecting pieces 1 and 2, which is formed of the male finger of part 1 and the female finger of part 2. Such a finger is well fitted to points, where great firmness is needed. In glulam joints the finger height h is usually h≈3-50 mm, the finger tip t≈0.5-2 mm, the glue groove g depending on glue and it is usually ≈0.1-1 mm. The finger bottom is usually chosen so that h/p≈3-6 where p is the pitch (base or root width). The number of fingers is usually fitted as large as possible, i.e. the distribution of fingers is p+t. Usually the outermost edges are different from the others, since by means of those fingers the edge of joint is shaped by ways aesthetically known to be of high quality.

FIG. 6 shows a straight or a little narrowing finger towards the tip. The cutters of parts 1 and 2 are as to their shape fitted as such so that in regard to the assembly a sufficient gap is formed in the finger joint and that the woody pieces are not compressed at all or only a little, so little that by assembly a joint tight enough is achieved by means of a small compression force without breaking the connecting pieces. By the production of such a joint the fingers of different size can be made without sideways motion of the cursor.

FIG. 7 shows a joint, where the finger of part 1 is straight and the finger of part 2 slightly narrowing towards the tip. Such fingers are suited for glulam joints, when in the finger bottoms a small play d is fitted, which usually is smaller than about 0.6 mm and, in addition, smaller than the greatest glue gap allowed for used glue. The joints lock by assembly, when the finger profiles are fitted to such ones that the fingers are tight in the tips or compressed some small measure e.

FIG. 8 shows a joint, where the cutting line is a U-shaped curve. By means of a solution like this the face of joint grows and at the same time also the firmness compared to the fact that the cutting face is straight. Yet a greater glue face and smaller wastage of material is reached if the cutting has the shape of letter S, or the cutting is slanting with respect to the connecting pieces. This kind of joint works without glue and even without any other joining means, if the joint is effected only by compression stress. If the joint is effected by a relatively small tension stress, as joining means in the joint there can be only nails or screws 5 at the same time.

FIG. 9 shows an angle joint, where the fingers shorten only in the concave corner. Such a solution is especially advantageous if the joint is strained by a moment, which causes compression in the concave corner. The cutting line is curved, so the joint length is greater if the cutting were straight. The cutting line can also have the shape of letter S or serrate. By means of the shape of cutting it is possible to adjust the firmness of joint and other properties as wanted. The cutting according to the figure is advantageous if part 1 is firmer or as to its crosscut greater.

FIG. 10 shows the angle joint of two wooden bars 1 and 2. It is essential that the cutting line is in the direction of neither bar but deviates from the directions of the bars as much as possible, i.e. the cutting line is advantageously approximately in the direction of the half the joint angle. A good result is also achieved so that cutting is as little as possible in the direction of the bars or as close as possible to the half of the joint angle. If no glue is used in the joint but for instance screws, nails etc., the joint area ought to be made as big as possible, whereby it is advantageous to carry out cutting so that the cutting grooves are straight extensions of the border line of the other part. In this case the routing end A has neither routings nor fingers outside the corner, i.e., the corner is called an "invisible" joint corner. In the routing end B fingers are visible. Invisible corners are also shown, e.g., at ends A and B of FIG. 1.

FIGS. 11, 12 show a T-joint of two pieces of different thickness. The finger is narrowing. The cutter cannot be moved sideways by cutting the fingers of part 1, so the fingers must be shaped just right by cutting of part 2. This example illustrates that the joint needs not to reach wholly the area of the connection piece. Among others, a solution like this is usable when the corner of joint is wanted to be of high class so that it has no splits, cutting errors etc. caused by cutting. Correspondingly, the joint can be greater than the connected bar.

FIGS. 13 and 14 show the joint of board 2 and woody piece 1. The board is thin, so the finger cannot be continuous, because it would weaken the board too much. When the finger is intermittent, being provided at distances f as shown in the figures, about half of the board can be without finger grooves. In such a case part 1 can be of timber but usually advantageously in the shape of a truss, serrate sawn or cut LVL, plywood etc. The finger shape shown in FIG. 7 is especially efficient, when the finger of part 1 is straight, usually advantageously made so that this part has no separate finger, but the edge of part 1 is milled or cut in shape of the female finger of part 2. Alternatively there is in part 1 a finger narrowing towards the finger tip, which for simplification of manufacture is worked outside the joining area, whereby moving of the cutter in the direction of the axle is not needed.

FIG. 15 shows a cutting tool, i.e., a cursor suitable to make the joints of this invention. Axle diameter is marked d, axle direction da and cutting direction dc.

Above some embodiments of the invention are presented. The inventive concept can be applied even in other ways within the limits of the claims.

The invention claimed is:

1. A finger joint between two woody parts, the finger joint comprising:

a first woody part and a second woody part; and a plurality of complementary finger pairs in the respective first woody part and second woody part;

said plurality of complementary fingers forming a finger joint having two ends and a middle formed therebetween, each said finger having a finger profile along a length thereof from root to tip, said profile narrowing in width from said root to said tip, wherein the fingers of at least one of the first woody part and the second woody part have:

(1) respective lengths which progressively increase from the joint ends toward the joint middle, such that the fingers on the ends are shorter than those in the middle, and (2) the respective widths of the tips of the fingers which progressively narrow from the joint ends towards the joint middle, such that the fingers on the ends are wider than those in the middle.

2. The finger joint of claim 1, wherein each finger tip of at least one of the woody parts has a different width.

3. The finger joint according to claim 2, wherein, in a joint corner, only one of the first woody part or the second woody part has fingers with progressively shorter lengths from the joint ends to the joint middle and progressively narrower tip widths from the joint ends toward the middle.

4. The finger joint according to claim 2, wherein, in a joint corner, both the first woody part and the second woody part have fingers with progressively shorter lengths from the joint ends to the joint middle and progressively narrower tip widths from the joint ends toward the middle.

5. A method to manufacture a finger joint between two woody parts, said method comprising:

cutting a series of fingers in a woody part, the series of fingers spanning between a first end and a second end of the woody part, defining a middle, therebetween, each finger having a profile from finger tip to finger root in which each respective finger tip is narrower than the respective finger root, wherein:

the series of fingers have respective lengths which progressively lengthen from the ends to the woody part towards the middle of the woody part, such that fingers in the middle of the woody part are longer than fingers at the ends of the woody part; and the series of fingers have respective tip widths which progressively narrow from the ends of the woody part towards the middle of the woody part, such that the tips of the fingers in the middle of the woody part are narrower than the tips of the fingers at the ends of the woody part;

wherein said cutting comprises:

selectively moving a cutting tool in a first direction, away from the woody part to vary the finger lengths progressively from shorter fingers at the ends of the woody part to longer in the middle of the woody part; and selectively moving the cutting tool in a second direction, perpendicular to the first direction, to thereby vary finger tip widths progressively from broader finger tip widths at the ends of the woody part to narrower finger tips at the middle of the woody part.

* * * * *